US009915428B2

(12) United States Patent
Kishida et al.

(10) Patent No.: US 9,915,428 B2
(45) Date of Patent: Mar. 13, 2018

(54) CYLINDER OF COMBUSTOR, METHOD OF MANUFACTURING OF CYLINDER OF COMBUSTOR, AND PRESSURE VESSEL

(71) Applicant: MITSUBISHI HITACHI POWER SYSTEMS, LTD., Yokohama-shi, Kanagawa-ken (JP)

(72) Inventors: Hiroaki Kishida, Yokohama (JP); Kentaro Tokuyama, Yokohama (JP); Yuta Hitomi, Yokohama (JP); Hiroyuki Sakaki, Yokohama (JP); Kotaro Miyauchi, Yokohama (JP); Kohei Hidaka, Lake Mary, FL (US); Susumu Wakazono, Lake Mary, FL (US); Scott Cloyd, Lake Mary, FL (US); Bob Provitola, Lake Mary, FL (US); Brandon Ruiz, Lake Mary, FL (US)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 740 days.

(21) Appl. No.: 14/463,816

(22) Filed: Aug. 20, 2014

(65) Prior Publication Data

US 2016/0053998 A1 Feb. 25, 2016

(51) Int. Cl.

| | |
|---|---|
| ***F23R 3/02*** | (2006.01) |
| ***F23R 3/00*** | (2006.01) |
| ***F01D 9/02*** | (2006.01) |

(52) U.S. Cl.

CPC ..... *F23R 3/002* (2013.01); *F01D 9/023* (2013.01); *F23R 3/005* (2013.01); *F23R 3/02* (2013.01);

(Continued)

(58) Field of Classification Search

CPC .. F23R 3/005; F23R 3/02; F23R 2900/00018; F23R 2900/03043; F23R 3/002; F01D 9/023; F02C 7/18

(Continued)

(56) References Cited

U.S. PATENT DOCUMENTS 5,808,266 A * 9/1998 Cecil ..... B23K 11/253 219/110
8,647,053 B2 * 2/2014 Hsu ..... F01D 9/023 415/115

(Continued)

FOREIGN PATENT DOCUMENTS

JP 2011-190717 A 9/2011
JP 2012-210652 A 11/2012

(Continued)

OTHER PUBLICATIONS

Design of Welded Joint and Structure, Journal of JWS, Mar. 2013, vol. 79, No. 2, pp. 54-59.

(Continued)

*Primary Examiner* — Phutthiwat Wongwian
*Assistant Examiner* — Jason T Newton
(74) *Attorney, Agent, or Firm* — Westerman, Hattori, Daniels & Adrian, LLP

(57) ABSTRACT

A cylinder of a combustor includes a cylinder body inside of which combustion gas flows, a jacket plate that covers the cylinder body from the outside and forms a fluid space into which high-pressure fluid flows between an inner peripheral surface of the jacket plate and an outer peripheral surface of the cylinder body, and a rib that connects the cylinder body and the jacket plate. The rib is connected to the cylinder body by a cylinder side end portion on the cylinder body side in a radial direction with respect to an axis of the cylinder body being welded from both sides in an axial direction of (Continued)

the axis. The rib is connected to the jacket plate by a jacket side end portion on the jacket plate side in the radial direction being welded from both sides in the axial direction.

17 Claims, 6 Drawing Sheets

(52) U.S. Cl.
CPC ..... *F23R 2900/00018* (2013.01); *F23R 2900/03043* (2013.01)

(58) Field of Classification Search
USPC ..... 60/722
See application file for complete search history.

(56) References Cited

U.S. PATENT DOCUMENTS

2004/0020212 A1* 2/2004 Hirota ..... B23K 9/0052 60/752
2011/0113785 A1* 5/2011 Tschuor ..... F01D 9/023 60/752
2011/0185739 A1* 8/2011 Bronson ..... F02C 7/18 60/755
2012/0275900 A1* 11/2012 Snider ..... F01D 9/023 415/108
2013/0167543 A1* 7/2013 McMahan ..... F01D 9/023 60/752
2013/0298564 A1* 11/2013 Agarwal ..... F01D 9/023 60/772

FOREIGN PATENT DOCUMENTS

JP 2013-72316 A 4/2013
WO 99/14532 A1 3/1999

OTHER PUBLICATIONS

International Search Report dated Jul. 28, 2015, issued in counterpart International PCT/JP2015/061711, with English translation ( 3 pages).
Written Opinion dated Jul. 28, 2015, issued in counterpart International PCT/JP2015/061711, with English translation (6 pages).

* cited by examiner

CYLINDER OF COMBUSTOR, METHOD OF MANUFACTURING OF CYLINDER OF COMBUSTOR, AND PRESSURE VESSEL

TECHNICAL FIELD

The present invention relates to a cylinder of a combustor, a method of manufacturing of a cylinder of a combustor, and a pressure vessel.

BACKGROUND ART

In a gas turbine, air pressurized by a compressor is mixed with fuel by a combustor so as to generate combustion gas which is a high-temperature fluid, and the combustion gas is introduced into a combustion gas flow channel of a turbine in which vanes and blades are alternately arranged. In addition, the blades and a rotor are rotated by the combustion gas circulating inside the combustion gas flow channel. In this manner, energy of the combustion gas is output as rotational energy, and the compressor or a generator is provided with a rotational drive force.

In the combustor of the gas turbine, in order to supply the high-temperature, high-pressure combustion gas to the turbine, components such as a transition piece and a combustor basket are exposed to the high-temperature combustion gas. For this reason, the components used in the combustor have a structure which introduces cooling air or steam in order to cool the components which become hot.

For example, Patent Document 1 discloses a structure which allows the steam to pass through a refrigerant passage by disposing a cooling jacket in which the refrigerant passage is formed on an outer periphery side of the transition piece of the combustor. The cooling jacket has multiple ribs which suppress the deformation caused by the pressure inside the refrigerant passage being increased by high-pressure steam. In order to form the refrigerant passage thereinside, these ribs are formed integrally with a plate material which forms a wall surface of the cooling jacket. Therefore, when the ribs are connected to an outer peripheral surface of the transition piece, welding cannot be performed from the inside of the cooling jacket which is on the refrigerant passage side. Consequently, the ribs are connected to the outer peripheral surface of the transition piece by welding only the outsides thereof.

CITATION LIST

Patent Literature

[Patent Document 1] Japanese Unexamined Patent Application, First Publication No. 2011-190717

SUMMARY OF INVENTION

Problem to be Solved by the Invention

However, one-side welding may cause a crack to grow from the inside which is under a high pressure. Accordingly, it is necessary to improve the bonding strength of the ribs.

The present invention provides a cylinder of a combustor, a method of manufacturing of a cylinder of a combustor, and a pressure vessel which can improve the bonding strength of a rib.

Means for Solving the Problem

In order to solve the above-described problem, the present invention proposes the following means.

According to a first aspect of the present invention, a cylinder of a combustor includes a cylinder body inside of which combustion gas flows, a jacket plate that covers the cylinder body from the outside and forms a fluid space into which high-pressure fluid flows between an inner peripheral surface of the jacket plate and an outer peripheral surface of the cylinder body, and a rib that connects the cylinder body and the jacket plate. The rib is connected to the cylinder body by a cylinder side end portion on the cylinder body side in a radial direction with respect to an axis of the cylinder body being welded from both sides in an axial direction of the axis. The rib is connected to the jacket plate by a jacket side end portion on the jacket plate side in the radial direction being welded from both sides in the axial direction.

According to this configuration, the cylinder side end portion of the rib is welded to the cylinder body from both sides in the axial direction, and the jacket side end portion is welded to the jacket plate from both sides in the axial direction. Therefore, it is possible to firmly fix the rib at the cylinder side end portion by welding the rib to the cylinder body so that the rib is held not from only one side but from both sides in the axial direction. Similarly, since both sides of the rib in the axial direction are welded to the jacket plate, it is possible to firmly fix the rib at the jacket side end portion. In addition, since the rib is welded not from only one side but from both sides in the axial direction, a crack is less likely to grow from any of the two sides in the axial direction. In this manner, it is possible to firmly fix the rib to the cylinder body and the jacket plate.

In addition, in the above-described cylinder of a combustor, in the cylinder body and the jacket plate, the distance between the outer peripheral surface of the cylinder body and the inner peripheral surface of the jacket plate may be constant in the axial direction. The rib may be formed to be perpendicular to both the outer peripheral surface of the cylinder body and the inner peripheral surface of the jacket plate.

According to this configuration, the rib is formed to be perpendicular to both the outer peripheral surface of the cylinder body and the inner peripheral surface of the jacket plate. Accordingly, when the rib is pressed by the high-pressure fluid flowing into the fluid space and a load is generated, it is possible to further decrease the bending stress generated in the rib. In this manner, it is possible to more firmly fix the rib to the cylinder body and the jacket plate.

In addition, in the above-described cylinder of a combustor, the rib may have multiple rib bodies which are arranged at a distance from each other in a circumferential direction with respect to the axis and which are connected to the cylinder body and the jacket plate, and multiple bridge portions which connect the rib bodies to each other in the circumferential direction.

According to this configuration, the rib has a structure in which the multiple rib bodies are connected to each other by the bridge portions. Accordingly, it is possible to improve the strength of the rib. Therefore, it is possible to further decrease the bending stress generated in the rib, and to more firmly fix the rib to the cylinder body and the jacket plate.

In addition, in the above-described cylinder of a combustor, the jacket plate may have a first jacket plate which is arranged on a first side in the axial direction with respect to the jacket side end portion, and a second jacket plate which is arranged on a second side in the axial direction with respect to the jacket side end portion. The first jacket plate and the second jacket plate may be connected to the rib in the jacket side end portion.

According to this configuration, the jacket plate is divided into the first jacket plate and the second jacket plate. Accordingly, the jacket plate can be easily welded to the rib. Specifically, the jacket plate is divided into separate components on one side and on the other side in the axial direction of the jacket side end portion of the rib. Accordingly, the first jacket plate and the second jacket plate can be easily arranged by being separately aligned with the jacket side end portion. Therefore, in the jacket side end portion, it is possible to easily weld the rib to the first jacket plate and the second jacket plate from both sides in the axial direction.

In addition, in the above-described cylinder of a combustor, the jacket plate may be formed with a through-hole penetrating in the radial direction, and the rib may be connected to the jacket plate by the jacket side end portion being inserted into and welded to the through-hole.

According to this configuration, the jacket plate having the through-hole is used. Accordingly, even when the jacket plate is formed as one member, it is possible to easily weld the jacket side end portion from the through-hole. Therefore, while the rib is welded from both sides in the axial direction, a cooling jacket can be formed using fewer components. This can reduce operation man-hours and operation costs.

In addition, according to a second aspect of the present invention, a method of manufacturing of a cylinder of a combustor includes a preparation step of preparing a cylinder body inside of which combustion gas flows, a jacket plate that covers the cylinder body from the outside and forms a fluid space into which high-pressure fluid flows between an inner peripheral surface of the jacket plate and an outer peripheral surface of the cylinder body, and a rib that connects the cylinder body and the jacket plate, a first welding step of connecting the rib to the cylinder body by welding a cylinder side end portion on the cylinder body side in a radial direction with respect to an axis of the cylinder body from both sides in an axial direction of the axis, and a second welding step of connecting the rib to the jacket plate by welding a jacket side end portion on the jacket plate side in the radial direction from both sides in the axial direction.

According to this configuration, in the first welding step, the cylinder side end portion of the rib is welded to the cylinder body from both sides in the axial direction. In the second welding step, the jacket side end portion is welded to the jacket plate from both sides in the axial direction. Therefore, it is possible to firmly fix the rib at the cylinder side end portion by welding the rib to the cylinder body so that the rib is held not from only one side but from both sides in the axial direction. Similarly, both sides of the rib are welded to the jacket plate in the axial direction. Accordingly, it is possible to firmly fix the rib at the jacket side end portion. In addition, since the rib is welded not from only one side but from both sides in the axial direction, a crack is less likely to grow from any of the two sides in the axial direction. In this manner, even when the rib is subjected to a load inside the fluid space in which the high-pressure fluid circulates, it is possible to stably maintain the bonded state and to firmly fix the rib to the cylinder body and the jacket plate.

In addition, in the method of manufacturing of a cylinder of a combustor, the preparation step may prepare a first jacket plate which is arranged on a first side in the axial direction with respect to the jacket side end portion of the rib, and a second jacket plate which is arranged on a second side in the axial direction with respect to the jacket side end portion. The second welding step may connect the first jacket plate and the second jacket plate to the rib in the jacket side end portion.

According to this configuration, the jacket plate is divided into the first jacket plate and the second jacket plate. Accordingly, it is possible to carry out the work separately on multiple large components. In this manner, it is possible to more easily weld the jacket plate to the rib.

In addition, in the method of manufacturing of a cylinder of a combustor, the preparation step may prepare the jacket plate in which a through-hole penetrating in the radial direction is formed. The second welding step may connect the rib to the jacket plate by inserting the jacket side end portion into the through-hole and welding it to the through-hole.

According to this configuration, the jacket plate having the through-hole is used in the second welding step. Accordingly, even when the jacket plate is formed as one member, it is possible to weld the jacket side end portion from the through-hole. Therefore, while the rib is welded from both sides in the axial direction, a cooling jacket can be formed using fewer components. This can reduce operation man-hours and operation costs.

In addition, according to a third aspect of the present invention, a pressure vessel includes a first wall plate, a second wall plate that opposes the first wall plate with a distance therebetween, and that forms a fluid space into which high pressure fluid flows between the first wall plate and the second wall plate, and a rib that connects the first wall plate and the second wall plate. The rib is connected to the first wall plate by a first end portion on the first wall plate side in a separation direction where the first wall plate and the second wall plate are separated from each other being welded from a first side in a direction perpendicular to the separation direction and from a second side which is opposite to the first side, with respect to the rib. The rib is connected to the second wall plate by a second end portion on the second wall plate side by being welded from a first side and a second side which is opposite to the first side, with respect to the rib.

According to this configuration, the first end portion of the rib is welded to the first wall plate from both sides in the direction perpendicular to the separation direction, and the second end portion is welded to the second wall plate from both sides in the direction perpendicular to the separation direction. Therefore, it is possible to improve the welding strength in the first end portion by welding the rib to the surface of the first wall plate so that the rib is held not from only one side but from both sides in a direction perpendicular to the separation direction. Similarly, since both sides of the rib in the direction perpendicular to the separation direction are welded to the second wall plate, it is possible to improve the welding strength in the second end portion. In this manner, it is possible to fix the rib to the first wall plate and the second wall plate firmly enough to maintain the bonded state even when the rib is subjected to a load inside the fluid space in which the high-pressure fluid circulates.

According to a cylinder of a combustor, a method of manufacturing of a cylinder of a combustor, and a pressure vessel of the present invention, it is possible to improve the bonding strength of a rib by welding the end portions of the rib from both sides in the axial direction.

BEST MODE FOR CARRYING OUT THE INVENTION

First Embodiment

Hereinafter, a first embodiment according to the present invention will be described with reference to FIGS. 1 to 5.

Figure 1:
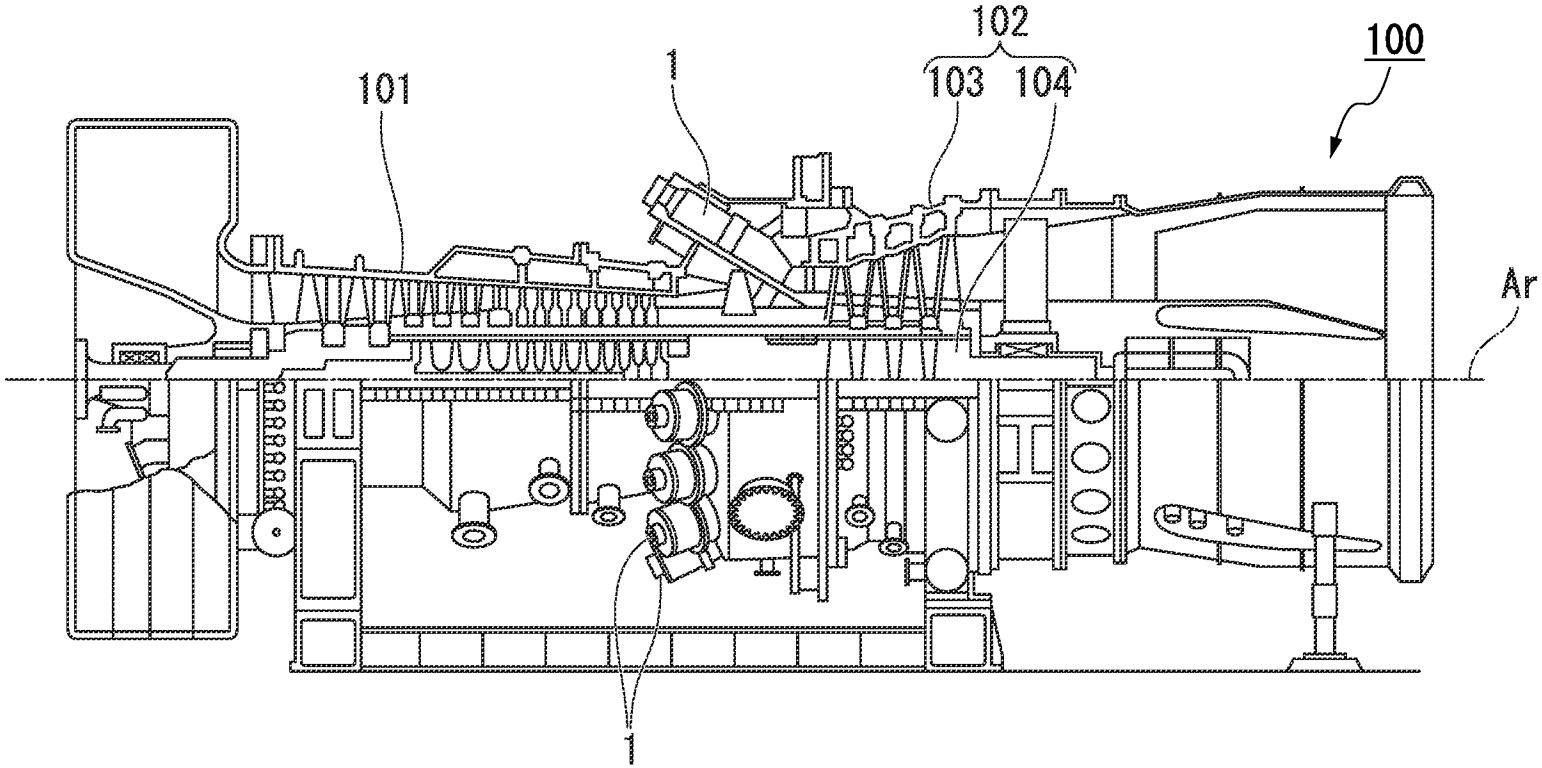
FIG. 1 is a side view showing a cutaway side surface of a main part of a gas turbine according to an embodiment of the present invention.

As shown in FIG. 1, a gas turbine 100 includes a compressor 101 which generates compressed air A by compressing ambient air, multiple combustors 1 which generate combustion gas G by mixing a fuel X supplied from a fuel supply source with the compressed air A and thereby causing combustion, and a turbine 102 which is driven by the combustion gas G.

The turbine 102 includes a casing 103 and a turbine rotor 104 rotated around a rotor axis Ar inside the casing 103. For example, the turbine rotor 104 is connected to a generator (not shown) which generates power by the rotation of the turbine rotor 104.

The compressor 101 is arranged on one side of the rotor axis Ar with respect to the turbine 102. The casing 103 of the turbine 102 has a cylindrical shape around the rotor axis Ar. In the compressor 101, the compressed air A is partially supplied to the turbine 102 or the combustor 1 as cooling air. Multiple combustors 1 are attached to the casing 103 at a distance from each other in a circumferential direction Dc with respect to the rotor axis Ar.

Figure 2:
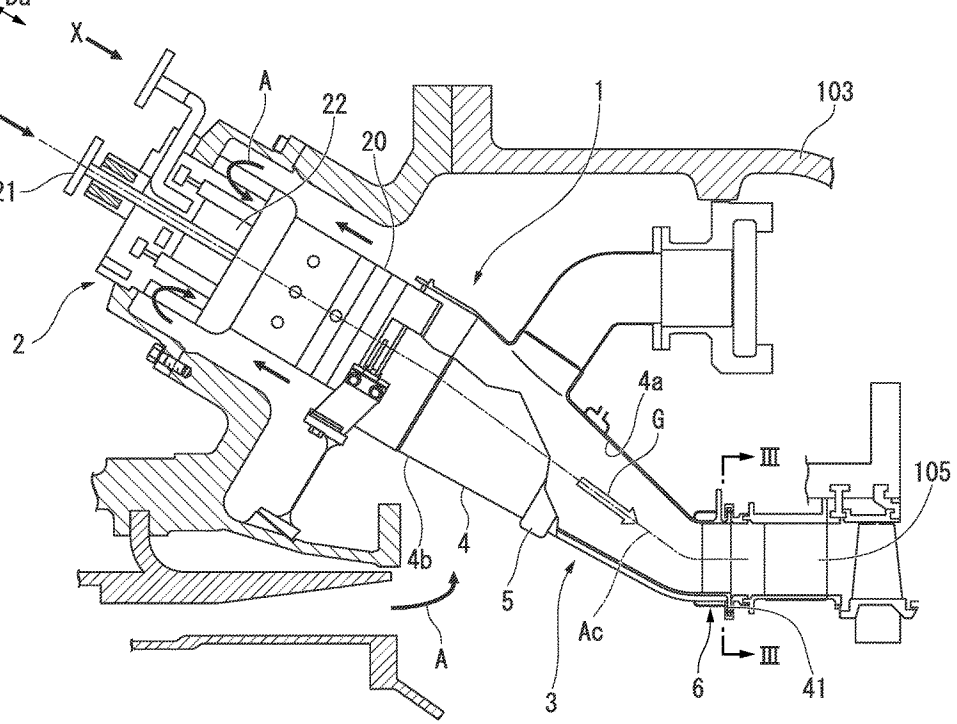
FIG. 2 is a cross-sectional view of a main part of a gas turbine according to an embodiment of the present invention.

As shown in FIG. 2, the combustor 1 is arranged inside the casing 103 of the turbine 102, and includes a transition piece 3 which delivers the high-temperature, high-pressure combustion gas G to the turbine 102 and a fuel supply unit 2 which supplies the fuel X and the compressed air A into the transition piece 3.

The fuel supply unit 2 has a combustor basket 20, a pilot nozzle 21 which forms a diffusion flame inside the combustor basket 20, and multiple main nozzles 22 which are arranged at equal intervals in the circumferential direction Dc around the pilot nozzle 21, and which form a premixed flame inside the combustor basket 20.

The transition piece 3 (a cylinder of a combustor) is connected to the combustor basket 20, and can supply the high-temperature, high-pressure combustion gas G generated in the combustor basket 20 to the gas turbine 102. As shown in FIG. 2, the transition piece 3 includes a cylinder body 4 having a cylindrical shape and a cooling jacket 6 formed so as to cover the cylinder body 4 from the outside.

Here, a direction in which an axis Ac of the cylinder body 4 extends is referred to as an axial direction Da, the circumferential direction Dc based on the axis Ac is simply referred to as the circumferential direction Dc, and a radial direction Dr based on the axis Ac is simply referred to as the radial direction Dr.

In addition, a side away from the axis Ac in the radial direction Dr is referred to as outside in the radial direction Dr, and a side opposite thereto is referred to as inside in the radial direction Dr. Furthermore, a side on which the transition piece 3 is present with respect to the fuel supply unit 2 in the axial direction Da is referred to as a downstream side, and a side opposite thereto is referred to as an upstream side.

The axis Ac of the cylinder body 4 in the present embodiment is a line passing through the position of the center of gravity in each cross section intersecting a direction in which the cylinder body 4 extends.

Figure 3:
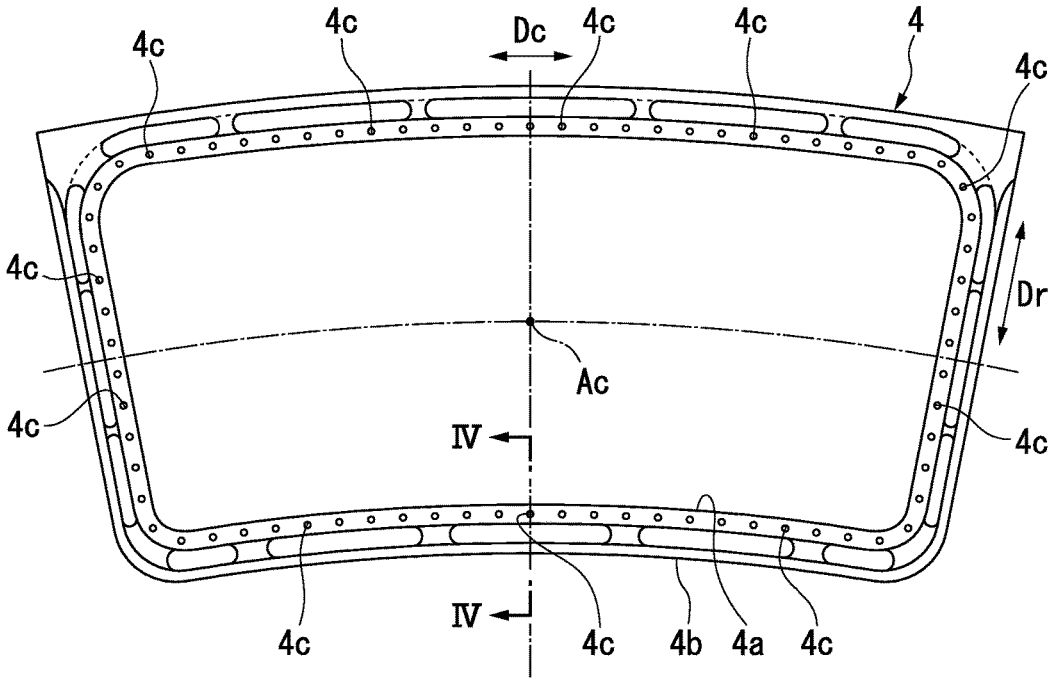
FIG. 3 is a cross-sectional view taken along line III-III in FIG. 2.

The combustion gas G flows inside the cylinder body 4. The cylinder body 4 is formed so that the cross-sectional area thereof gradually decreases from the upstream side toward the downstream side in the axial direction Da. In the cylinder body 4, a flange 41 extending from an outer peripheral surface 4*b* toward the outside in the radial direction Dr is formed in the downstream end. In the cylinder body 4, an inlet portion which is the upstream end thereof is connected to the combustor basket 20, and an outlet portion which is the downstream end thereof is connected to a first stage vane 105 of the turbine 102. As shown in FIG. 3, the cylinder body 4 in the present embodiment has a fan shape in cross section, and is formed in a cylindrical shape. Multiple cooling flow channels 4*c* are formed between an inner peripheral surface 4*a* and the outer peripheral surface 4*b* in the cylinder body 4. In the cylinder body 4 of the present embodiment, a groove portion 4*d* (refer to FIG. 4) which is recessed from the outer peripheral surface 4*b* to the inner peripheral surface 4*a* side is formed at a position on the upstream side of the flange 41 and along the flange 41 so as to extend in the circumferential direction Dc.

On the upstream side, the cooling flow channel 4*c* is connected to a steam inflow jacket 5 (refer to FIG. 2) which is disposed on the outer peripheral surface 4*b* of the cylinder body 4 and into which high-pressure steam P (high-pressure fluid) flows from the outside. The high-pressure steam P is introduced into the cooling flow channel 4*c* from the steam inflow jacket 5, and is circulated to the downstream side. The cooling flow channel 4*c* communicates with the groove portion 4*d* in the downstream end. The cooling flow channel 4*c* of the present embodiment has a circular shape in cross section. Multiple cooling flow channels 4*c* are formed between the inner peripheral surface 4*a* and the outer peripheral surface 4*b* of the cylinder body 4 at a distance from each other in the circumferential direction Dc.

Figure 4:
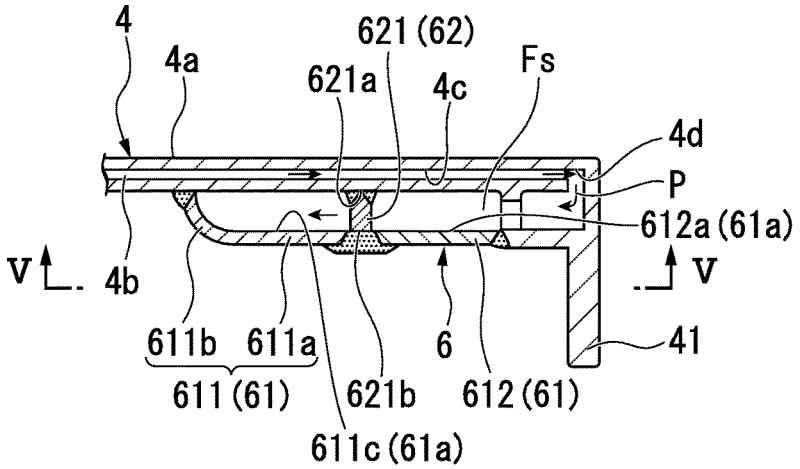
FIG. 4 is a cross-sectional view taken along line IV-IV in FIG. 3.

As shown in FIG. 4, the groove portion 4*d* is formed so that an entire opening on the downstream side of the cooling flow channel 4*c* faces a side surface of the groove portion 4*d*, and that the distance from the outer peripheral surface 4*b* of the cylinder body 4 to an edge on the inside in the radial direction Dr of the cooling flow channel 4*c* is the same as the distance from the outer peripheral surface 4*b* of the cylinder body 4 to a bottom of the groove portion 4*d*.

The cooling jacket 6 is formed in the outlet portion on the downstream side of the cylinder body 4. As shown in FIG. 4, the cooling jacket 6 of the present embodiment has a jacket plate 61 which covers the cylinder body 4 from the outside and a rib 62 which connects the cylinder body 4 and the jacket plate 61 to each other.

The jacket plate 61 forms a fluid space FS into which the high-pressure steam P flows surrounded by an inner peripheral surface 61*a* thereof, the outer peripheral surface 4*b* of the cylinder body 4, and the flange 41. The fluid space FS of the present embodiment communicates with the downstream end of the cooling flow channel 4*c* via the groove portion 4*d*, and the high-pressure steam P circulating through the cooling flow channel 4*c* flows into the fluid space FS. The high-pressure steam P slowly flows from the downstream side toward the upstream side in the fluid space FS, and the high-pressure steam P is discharged to the outside from a steam outlet (not shown). The jacket plate 61 of the present embodiment has a first jacket plate 611 arranged on the upstream side and a second jacket plate 612 arranged on the downstream side.

The first jacket plate 611 is connected to the outer peripheral surface 4*b* of the cylinder body 4 and the rib 62. The first jacket plate 611 is arranged at a distance from the outer peripheral surface 4*b* of the cylinder body 4 so as to form a space between the outer peripheral surface 4*b* of the cylinder body 4 and the first jacket plate 611. The first jacket plate 611 of the present embodiment has a flat plate portion 611*a* which has a flat plate shape and is connected to the rib 62, and a curved portion 611*b* which has a curved shape and is formed integrally with the flat plate portion 611*a* and which is connected to the outer peripheral surface 4*b* of the cylinder body 4.

The flat plate portion 611*a* extends along the outer peripheral surface 4*b* of the cylinder body 4, and the cross-sectional shape parallel to the axis Ac is a rectangular shape. The flat plate portion 611*a* is formed so that the inner peripheral surface 611*c* facing the cylinder body 4 side and the outer peripheral surface 4*b* of the cylinder body 4 oppose each other with a distance therebetween. The flat plate portion 611*a* is formed so that the distance between the inner peripheral surface 611*c* thereof and the outer peripheral surface 4*b* of the cylinder body 4 is constant in the axial direction Da. In the flat plate portion 611*a*, an end portion on the downstream side is welded to the rib 62.

The curved portion 611*b* extends to the upstream side integrally from the flat plate portion 611*a*, and has a convex shape in which the cross-sectional shape parallel to the axis Ac protrudes outward. In the curved portion 611*b*, an end portion on the upstream side is welded to the outer peripheral surface 4*b* of the cylinder body 4 from the outside.

The second jacket plate 612 is connected to the rib 62 and the flange 41 of the cylinder body 4. The second jacket plate 612 is arranged at a distance from the outer peripheral surface 4*b* of the cylinder body 4 so as to from a space between the outer peripheral surface 4*b* of the cylinder body 4 and the second jacket plate 612. In the second jacket plate 612 of the present embodiment, the cross-sectional shape intersecting the axis Ac is a rectangular shape. The second jacket plate 612 is formed so that the distance between the inner peripheral surface 612*a* facing the cylinder body 4 side and the outer peripheral surface 4*b* of the cylinder body 4 is the same as that in the flat plate portion 611*a* of the first jacket plate 611, and so that the distance is constant in the axial direction Da. In the second jacket, an end portion on the upstream side is welded to the rib 62 from the outside in the radial direction Dr, and an end portion on the downstream side is welded to a surface facing the upstream side of the flange 41 from the outside in the radial direction Dr.

The rib 62 has a rib body 621 in which an end portion inside in the radial direction Dr is a cylinder side end portion 621*a* and an end portion outside in the radial direction Dr is a jacket side end portion 621*b*.

Multiple rib bodies 621 are arranged at a distance from each other in the circumferential direction Dc. The rib body 621 is formed so as to be perpendicular to the outer peripheral surface 4*b* of the cylinder body 4 and the inner peripheral surface 61*a* of the jacket plate 61. The rib body 621 is connected to the cylinder body 4 by the cylinder side end portion 621*a* being welded from both sides in the axial direction Da. The rib body 621 is connected to the jacket plate 61 by the jacket side end portion 621*b* being welded from both sides in the axial direction Da.

Figure 5:
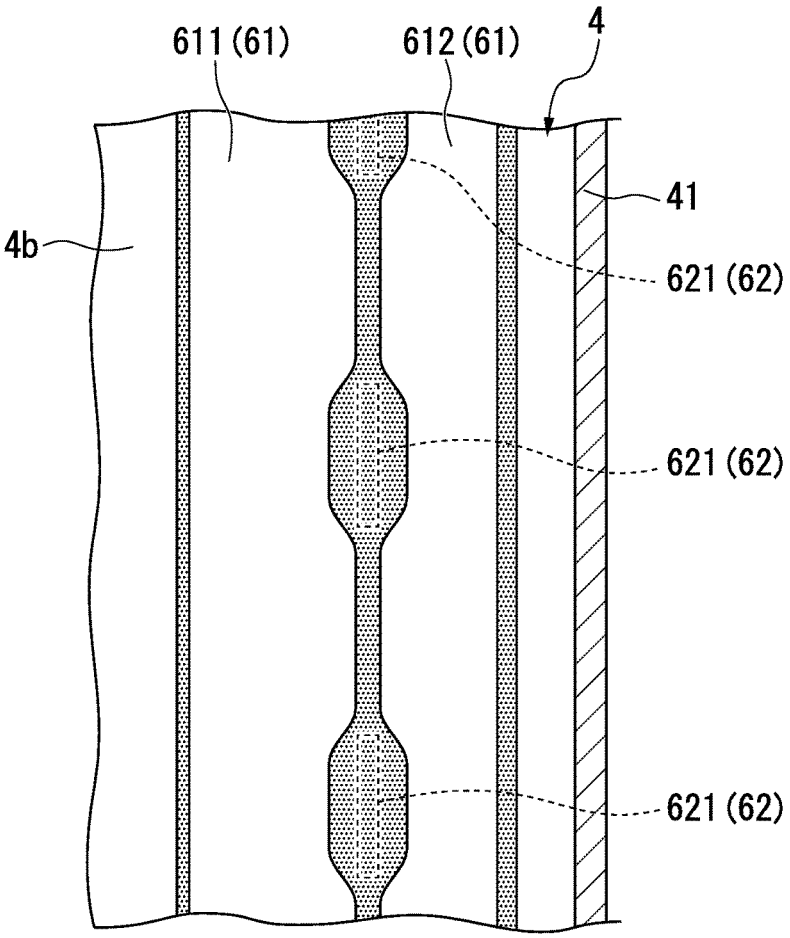
FIG. 5 is a view showing a state in the cross-sectional view taken along line V-V in FIG. 4.

Specifically, the rib body 621 of the present embodiment is a plate-shaped member which extends in the circumferential direction Dc. In the rib body 621 of the present embodiment, in the cross-sectional shape parallel to the axis Ac, the jacket side end portion 621*b* is formed in a planar shape, and the cylinder side end portion 621*a* is formed at an acute angle so that the diameter thereof gradually decreases from the jacket side end portion 621*b* side toward the cylinder side end portion 621*a* side. In the rib bodies 621 of the present embodiment, the cylinder side end portions 621*a* formed at the acute angle are each welded to the outer peripheral surface 4*b* of the cylinder body 4 from both sides in the axial direction Da. In the rib body 621 of the present embodiment, as shown in FIG. 5, the jacket side end portion 621*b* is arranged between the first jacket plate 611 and the second jacket plate 612, and is welded to the first jacket plate 611 and the second jacket plate 612 from the outside in the radial direction Dr including both sides in the axial direction Da.

The clearance in the axial direction Da between the first jacket plate 611 and the second jacket plate 612 where the rib 62 is not arranged is also welded to connect the first jacket plate and the second jacket plate.

Next, a method of manufacturing a cylinder of a combustor according to a first embodiment will be described.

In the method of manufacturing of the transition piece 3 (a cylinder of a combustor), the transition piece 3 having the cooling jacket 6 is manufactured. A manufacturing method S10 of the transition piece according to the present embodiment includes a preparation step S11 of preparing the cylinder body 4, the jacket plate 61, and the rib 62 in advance, a first welding step S12 of welding the rib 62 to the cylinder body 4, a second welding step S13 of welding the jacket plate 61 to the rib 62, and a third welding step S14 of welding the jacket plate 61 to the cylinder body 4.

In the preparation step S11, members needed to manufacture the transition piece 3 are prepared in advance. In the preparation step S11 of the present embodiment, the cylinder body 4, the jacket plate 61, and the rib 62 as described above are prepared. In the preparation step S11 of the present embodiment, the first jacket plate 611 and the second jacket plate 612 are prepared as the jacket plate 61, and multiple rib bodies 621 are prepared as the rib 62.

In the first welding step S12, the cylinder side end portion 621*a* of the rib body 621 is welded and connected to the cylinder body 4 from both sides in the axial direction Da. Specifically, in the first welding step S12 of the present embodiment, the rib body 621 is arranged perpendicularly with the cylinder side end portion 621*a* facing the outer peripheral surface 4*b* of the cylinder body 4. In the first welding step S12 of the present embodiment, the cylinder side end portion 621*a*, which has an acute angle shape, of the perpendicularly arranged rib body 621 is welded to the outer peripheral surface 4*b* of the cylinder body 4 from a first side (one side) in the axial direction Da, so as to fill the clearance between the cylinder side end portion 621*a* and the outer peripheral surface 4*b*. Thereafter, the cylinder side end portion 621*a* is welded to the outer peripheral surface 4*b* from a second side (the outside) in the axial direction Da. For example, in the present embodiment, when the cylinder side end portion 621*a* is welded to the outer peripheral surface 4*b* from the upstream side in the axial direction Da, thereafter the cylinder side end portion 621*a* is welded to the outer peripheral surface 4*b* from the downstream side in the axial direction Da, so as to fill the clearance between the cylinder side end portion 621*a* and the outer peripheral surface 4*b*. The first welding step S12 of the present embodiment is performed multiple times corresponding to the number of the rib bodies 621 which are to be connected to the cylinder body 4.

In the second welding step S13, the jacket side end portion 621*b* of the rib body 621 is welded and connected to the jacket plate 61 from both sides in the axial direction Da. Specifically, in the second welding step S13 of the present embodiment, the first jacket plate 611 and the second jacket plate 612 are arranged perpendicularly to the jacket side end portion 621*b* of the rib body 621 welded to the cylinder body 4 during the first welding step S12. In the second welding step S13 of the present embodiment, in a state where the first jacket plate 611 and the second jacket plate 612 are arranged with respect to the jacket side end portion 621*b*, the jacket side end portion 621*b* is welded to the end portion on the downstream side of the first jacket plate 611 and the end portion on the upstream side of the second jacket plate 612 from the outside in the radial direction Dr. In this manner, in the second welding step S13, in a state which is the same as the state where the jacket side end portion 621*b* is welded from both sides in the axial direction Da, the jacket side end portion 621*b* is welded to the first jacket plate 611 and the second jacket plate 612, while the first jacket plate 611 and the second jacket plate 612 are welded and connected to each other. In addition, in the second welding step S13 of the present embodiment, in a portion between the rib bodies 621 in the circumferential direction Dc in which the rib body 621 is not arranged, the clearance in the axial direction Da between the first jacket plate 611 and the second jacket plate 612 is welded from the outside in the radial direction Dr entirely along the circumferential direction Dc so that the first jacket plate 611 and the second jacket plate 612 are connected to each other.

In the third welding step S14, the jacket plate 61 welded to the rib 62 is welded and connected to the cylinder body 4. In the third welding step S14 of the present embodiment, the first jacket plate 611 welded to the rib body 621 is welded to the outer peripheral surface 4*b* of the cylinder body 4, and the second jacket plate 612 is welded to the flange 41. Specifically, in the third welding step S14 of the present embodiment, the end portion on the upstream side of the curved portion 611*b* of the first jacket plate 611 and the outer peripheral surface 4*b* of the cylinder body 4 are welded from the outside in the radial direction Dr and the upstream side in the axial direction Da entirely along the circumferential direction Dc. In the third welding step S14 of the present embodiment, the end portion on the downstream side of the second jacket plate 612 and a surface facing the upstream side of the flange 41 are welded together from the outside in the radial direction Dr entirely along the circumferential direction Dc.

Next, an operation of the above-described gas turbine 100 will be described.

According to the gas turbine 100 of the first embodiment, the compressed air A supplied from the compressor 101 enters the inside of the casing 103 of the turbine 102 and flows into the combustor 1. In the combustor 1, the fuel X supplied with the compressed air A from the outside is combusted by the main nozzle 22 and the pilot nozzle 21 so as to generate the combustion gas G. During the process of passing through the combustion gas flow channel, the combustion gas G comes into contact with a blade body and rotates the turbine rotor 104 around the rotor axis Ar.

In addition, in the transition piece 3, the high-temperature combustion gas G generated by the main nozzle 22 and the pilot nozzle 21 circulates inside the cylinder body 4 from the upstream side toward the downstream side. The cylinder body 4 is formed so that the cross-sectional area thereof gradually decreases as it extends toward the downstream side. Therefore, in the cylinder body 4, the heat transfer rate of the combustion gas G increases toward the downstream end where the flange 41 is formed. The downstream end is exposed to the most severe thermal environment.

Therefore, in the present embodiment, the high-pressure steam P whose heat capacity is greater than that of air is caused to flow in the cooling flow channel 4*c* formed between the inner peripheral surface 4*a* and the outer peripheral surface 4*b* of the cylinder body 4. The high-pressure steam P for cooling flows into the steam inflow jacket 5 from the outside, and flows into the multiple cooling flow channels 4*c* of the cylinder body 4 from the inside of the steam inflow jacket 5. During the process of passing through each cooling flow channel 4*c* of the cylinder body 4, the high-pressure steam P cools the cylinder body 4. Thereafter, the high-pressure steam P is injected into the groove portion 4*d* from the cooling flow channel 4*c* of the cylinder body 4. The high-pressure steam P collides with a side surface of the groove portion 4*d* on the downstream side and a surface facing the upstream side of the flange 41 which is connected to the side surface of the groove portion 4*d* on the downstream side, and performs impingement cooling on the flange 41.

The high-pressure steam P which collides with the surface facing the upstream side of the flange 41 flows into the fluid space FS of the cooling jacket 6 disposed on the outer periphery side of the downstream end of the cylinder body 4, and is collected from the cooling jacket 6 via a pipe (not shown). The cooling jacket 6 is formed so as to have a relatively larger internal volume than that of the cooling flow channel 4*c*. Therefore, it is possible to decrease the flow resistance of the high-pressure steam P injected from the cooling flow channel 4*c* of the cylinder body 4. Accordingly, it is possible to increase the flow rate of the high-pressure steam P flowing in the cooling flow channel 4*c* of the cylinder body 4.

In the transition piece 3 as described above, the high-pressure steam P flows from the cooling flow channel 4*c* into the fluid space FS which is formed by the first jacket plate 611 and the second jacket plate 612, thereby generating pressure outward from the inside of the fluid space FS. Therefore, stress is generated to the rib body 621, the first jacket plate 611, and the second jacket plate 612, thereby applying a load to the welded portion. Here, if the welding strength is insufficient, the force is concentrated on the welded portion so as to tear off the welded portion of the rib body 621, and a crack appears in the welded portion. Consequently, there is a possibility that the welded portion of the rib body 621 may be damaged due to the growing crack.

However, in the present embodiment, in the first welding step S12, the cylinder side end portion 621*a* of the rib body 621 is welded to the cylinder body 4 from both sides in the axial direction Da. In the second welding step S13, the jacket side end portion 621*b* is welded to the first jacket plate 611 and the second jacket plate 612 from the outside in the radial direction Dr including both sides in the axial direction Da. Therefore, it is possible to firmly fix the rib body 621 to the cylinder side end portion 621*a* by welding the rib body 621 to the outer peripheral surface 4*b* of the cylinder body 4 so that the rib body 621 is held not from only one side but from both sides in the axial direction Da. Similarly, since both sides of the rib body 621 in the axial direction Da are welded to the first jacket plate 611 or the second jacket plate 612, it is possible to firmly fix the rib body 621 to the jacket side end portion 621*b*. In addition, since the rib body 621 is welded not from only one side but from both sides in the axial direction Da, it is possible to make a crack less likely to grow from any of the two sides in the axial direction Da. Therefore, the first welding step S12 and the second welding step S13 can make the crack further less likely to appear. In this manner, it is possible to fix the rib body 621 to the cylinder body 4, the first jacket plate 611, and the second jacket plate 612 firmly enough to stably maintain the bonded state even when the rib body is subjected to a load inside the fluid space FS in which the high-pressure steam P circulates. Therefore, it is possible to improve the bonding strength of the rib 62 with respect to the cylinder body 4, the first jacket plate 611, and the second jacket plate 612.

In addition, the rib body 621 is formed so as to be perpendicular to each of the outer peripheral surface 4*b* of the cylinder body 4 and the inner peripheral surfaces 611*c* and 612*a* of the first jacket plate 611 and the second jacket plate 612. Accordingly, it is possible to further decrease the bending stress generated in the rib body 621 when the high-pressure steam P flowing into the fluid space FS presses the rib body 621 and thus a load is generated. In this manner, it is possible to more firmly fix the rib body 621 to the cylinder body 4, the first jacket plate 611, and the second jacket plate 612.

Furthermore, the jacket plate 61 is divided into the first jacket plate 611 and the second jacket plate 612. Accordingly, it is possible to easily weld the jacket plate 61 to the rib body 621. Specifically, since the jacket plate 61 is divided into separate components on the upstream side and the downstream side in the axial direction Da of the jacket side end portion 621*b* of the rib body 621, the first jacket plate 611 and the second jacket plate 612 can be easily arranged by being separately aligned with the jacket side end portion 621*b*. Therefore, in the jacket side end portion 621*b*, it is possible to easily weld the rib body 621 to the first jacket plate 611 and the second jacket plate 612 from both sides in the axial direction Da.

In addition, it is possible to weld the cylinder side end portion 621*a* of the rib body 621 to the outer peripheral surface 4*b* of the cylinder body 4 from both sides in the axial direction Da in the first welding step S12, and thereafter to weld the rib body 621 to the first jacket plate 611 and the second jacket plate 612 in the second welding step S13. Therefore, after both sides of the cylinder side end portion 621*a* in the axial direction Da are welded in the first welding step S12, it is possible to easily check whether the upstream side and the downstream side in the axial direction Da are reliably welded. In addition, in the first welding step S12, in a state where the jacket plate 61 is not arranged, the cylinder side end portion 621*a* of the rib body 621 can be welded from both sides in the axial direction Da. Therefore, it is possible to easily weld the cylinder side end portion 621*a* while checking the upstream side and the downstream side in the axial direction Da.

Furthermore, the jacket plate 61 is divided into the first jacket plate 611 and the second jacket plate 612. Accordingly, it is possible to carry out the work separately on multiple large components. In this manner, it is possible to more easily weld the jacket plate 61 to the rib body 621.

Second Embodiment

Next, the transition piece 3 according to a second embodiment will be described with reference to FIGS. 6 and 7.

In the second embodiment, the same reference numerals are given to configuration elements which are the same as those in the first embodiment, and a detailed description thereof will be omitted here. In the transition piece 3 of the second embodiment, the configuration of a rib 72 is different from that of the first embodiment.

Figure 6:
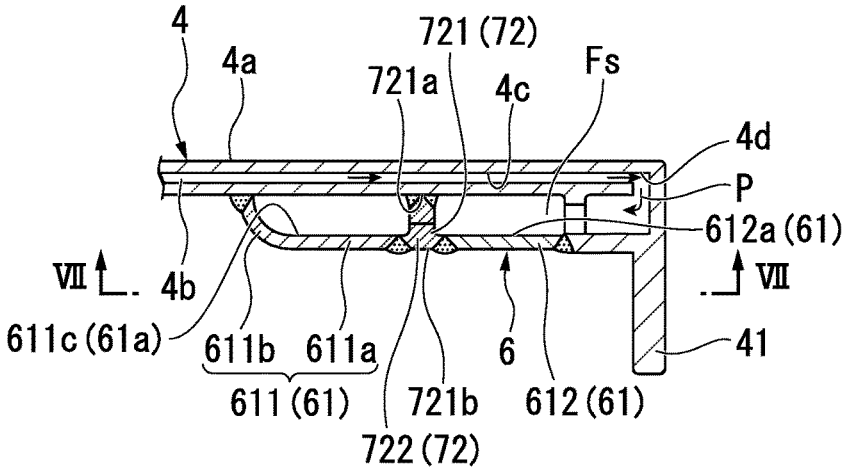
FIG. 6 is a cross-sectional view corresponding to the cross-sectional view taken along line IV-IV in FIG. 3 according to a second embodiment.
Figure 7:
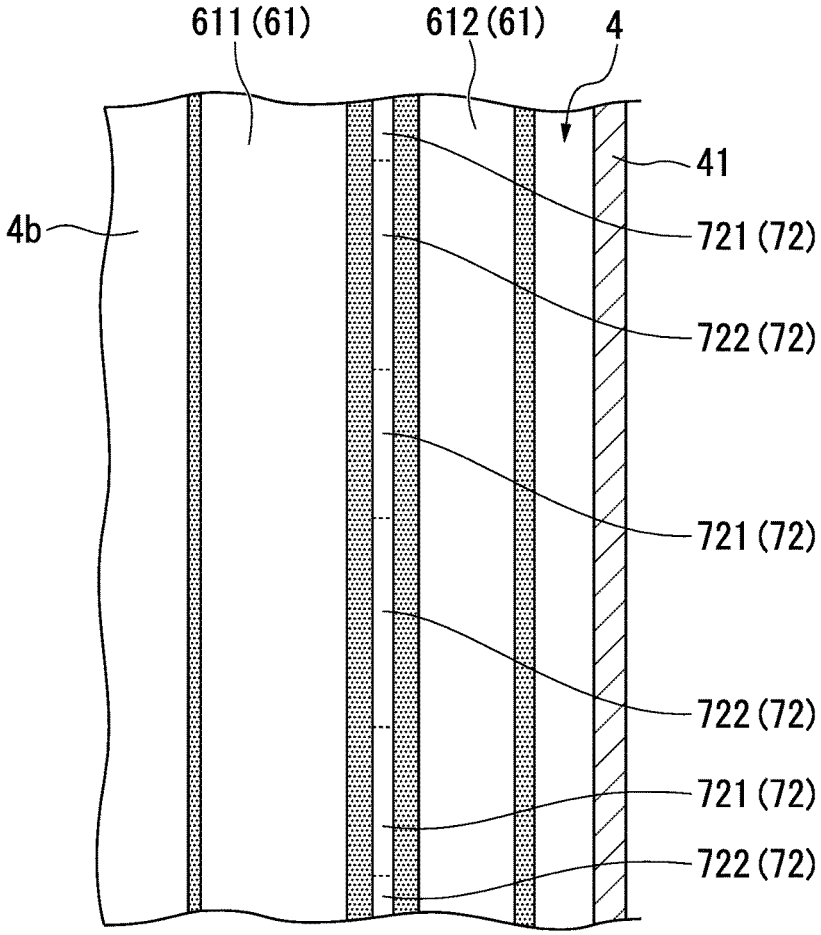
FIG. 7 is a view showing a state in the cross-sectional view taken along line VII-VII in FIG. 6.

As shown in FIG. 6, the rib 72 of the second embodiment has rib bodies 721 which are the same as those of the first embodiment, and multiple bridge portions 722 which connect the rib bodies 721 to each other in the circumferential direction Dc.

The bridge portion 722 connects end surfaces opposing each other in the circumferential direction Dc of the rib bodies 721 adjacent to each other in the circumferential direction Dc. In the present embodiment, the bridge portion 722 is formed so as to connect surfaces facing in the circumferential direction Dc of the multiple rib bodies 721 on a jacket side end portion 721*b* side. Specifically, in the bridge portion 722 of the present embodiment, the jacket side end portion 721*b* is formed integrally with the rib main body 721, and is formed so as to be smooth and coplanar. In a state where the bridge portion 722 of the present embodiment is welded to the first jacket plate 611 and the second jacket plate 612, the bridge portion 722 has a cross-sectional shape parallel to the axis Ac so that a cylinder side end portion 721*a* side protrudes from the inner peripheral surface 4*a* of the first jacket plate 611 and the second jacket plate 612. Therefore, in the present embodiment, the multiple bridge portions 722 are formed integrally with the multiple rib bodies 721 and configure the rib 72 as one member extending in the circumferential direction Dc.

In the present embodiment, similarly to the first embodiment, in the rib 72, the cylinder side end portion 721*a* of the rib body 721 is welded to the inner peripheral surface 4*a* of the cylinder body 4 from both sides in the axial direction Da. In addition, in the rib 72, as shown in FIG. 7, the rib body 721 and the jacket side end portion 721*b* of the bridge portion 722 are welded to the first jacket plate 611 from the downstream side in the axial direction Da, and are welded to the second jacket plate 612 from the upstream side in the axial direction Da. In this manner, the rib 72 is welded to the jacket plate 61 from both sides in the axial direction Da.

According to the transition piece 3 as described above, since the rib 72 has a structure which connects the multiple rib bodies 721 to each other with the bridge portion 722, it is possible to improve the strength of the rib 72. That is, as compared to a state where the multiple rib bodies 721 serving as separate members are welded to the cylinder body 4, the first jacket plate 611, or the second jacket plate 612, it is possible to improve the strength against a load generated by the high-pressure steam P inside the fluid space FS in a state where the rib bodies 721 serving as a single member are welded. Therefore, it is possible to further decrease the bending stress generated in the rib 72. Accordingly, it is possible to more firmly fix the rib 72 to the cylinder body 4, the first jacket plate 611, and the second jacket plate 612.

Third Embodiment

Figure 8:
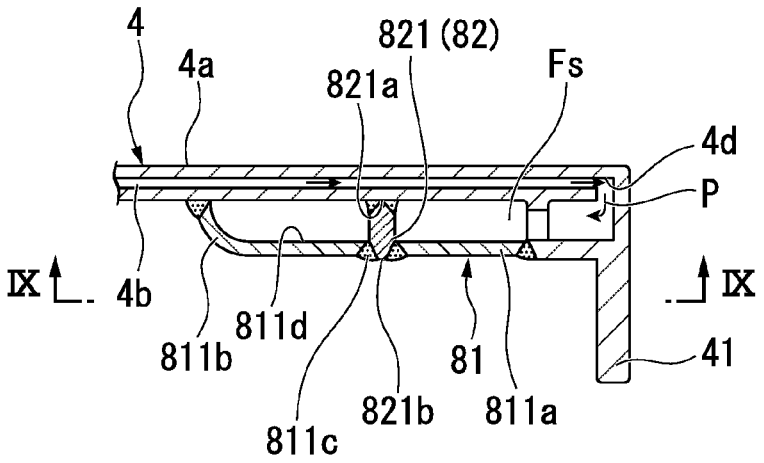
FIG. 8 is a cross-sectional view corresponding to the cross-sectional view taken along line IV-IV in FIG. 3 according to a third embodiment.
Figure 9:
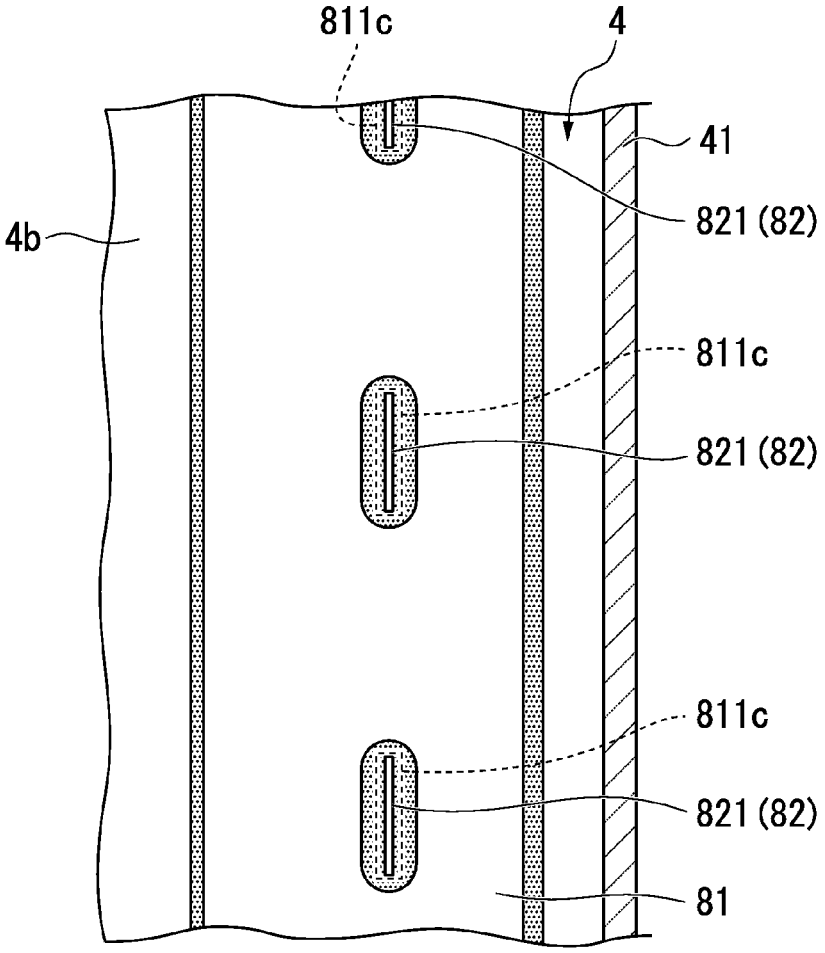
FIG. 9 is a view showing a state in the cross-sectional view taken along line IX-IX in FIG. 8.

Next, the transition piece 3 according to a third embodiment will be described with reference to FIGS. 8 and 9.

In the third embodiment, the same reference numerals are given to configuration elements which are the same as those in the first embodiment and the second embodiment, and a detailed description thereof will be omitted here. In the transition piece 3 of the third embodiment, the configuration of the jacket plate 61 is different from that of the first embodiment and the second embodiment.

The jacket plate 61 of the third embodiment is different from that in the first embodiment or the second embodiment, and the third embodiment has a perforated jacket plate 81 which is a single member.

The perforated jacket plate 81 forms the fluid space FS into which high-pressure fluid flows surrounded by an inner peripheral surface 811*d*, the outer peripheral surface 4*b* of the cylinder body 4, and the flange 41. The perforated jacket plate 81 has a through-hole 811*c* penetrating in the radial direction Dr. The perforated jacket plate 81 of the present embodiment is a member having an outer diameter shape in which the first jacket plate 611 and the second jacket plate 612 of the first embodiment are connected to each other. Specifically, as shown in FIG. 8, the perforated jacket plate 81 of the present embodiment has a perforated flat plate portion 811*a* which has a flat plate shape and in which the through-hole 811*c* is formed, and a curved portion 811*b* which has a curved shape and is formed integrally with the perforated flat plate portion 811*a*.

The perforated flat plate portion 811*a* extends along the outer peripheral surface 4*b* of the cylinder body 4, and is configured so that the cross-sectional shape parallel to the axis Ac is a rectangular shape. The perforated flat plate portion 811*a* of the present embodiment has a shape in which the flat plate portion 611*a* of the first jacket plate 611 and the second jacket plate 612 of the first embodiment are connected to each other in the axial direction Da. The perforated flat plate portion 811*a* is formed so that the distance between the inner peripheral surface 811*d* facing the cylinder body 4 side and the outer peripheral surface 4*b* of the cylinder body 4 is constant in the axial direction Da. In the perforated flat plate portion 811*a*, the end portion on the downstream side is welded to a surface facing the upstream side of the flange 41 from the outside in the radial direction Dr. In the perforated flat plate portion 811*a*, multiple through-holes 811*c* penetrating in the radial direction Dr are formed at a distance from each other in the circumferential direction Dc.

The through-hole 811*c* of the present embodiment is configured so that the cross-sectional shape in the radial direction Dr has an oval cross section, and penetrates the perforated flat plate portion 811*a* in the radial direction Dr. As shown in FIG. 9, in a state where the perforated jacket plate 81 is fixed to the cylinder body 4, the multiple through-holes 811*c* of the present embodiment are formed at positions where the positions viewed from the outside in the radial direction Dr overlap the positions at which the rib bodies 821 are disposed.

The curved portion 811*b* has a shape which is the same as that of the curved portion 811*b* in the first embodiment, and extends to the upstream side from the perforated flat plate portion 811*a*. In the curved portion 811*b*, an end portion on the upstream side is welded to the inner peripheral surface 4*a* of the cylinder body 4 from the outside.

In addition, in the third embodiment, the rib body 821 is formed so as to be longer in the radial direction Dr than that of the first embodiment. Similarly to the cylinder side end portion 821*a*, the rib body 821 of the third embodiment is formed at an acute angle so that the diameter of the jacket side end portion 821*b* gradually decreases from the cylinder side end portion 821*a* side toward the jacket side end portion 821*b* side. Specifically, in a state where the rib body 821 is inserted into and welded to the through-hole 811*c* of the perforated jacket plate 81, the rib body 821 of the third embodiment is formed to have such a length that a distal end of the jacket side end portion formed at an acute angel protrudes outward in the radial direction Dr from the surface on the outside of the perforated jacket plate 81.

Next, the manufacturing method S10 of the transition piece according to the third embodiment will be described.

In the third embodiment, a second welding step S130 is different from that in the manufacturing method S10 of the transition piece of the first embodiment.

In the second welding step S130 of the third embodiment, the jacket side end portion 821*b* of the rib body 821 is welded from both sides in the axial direction Da and connected to the perforated jacket plate 81. Specifically, similarly to the first embodiment, the second welding step S130 of the third embodiment is performed after the rib body 821 is welded to the outer peripheral surface 4*b* of the cylinder body 4 in the first welding step S12. In the second welding step S130, the perforated jacket plate 81 is arranged so that the position of the rib body 821 welded to the cylinder body 4 overlaps the position of the through-hole 811*c*, and so that the jacket side end portion 821*b* of the rib body 821 is inserted into the through-hole 811*c*. Furthermore, in the second welding step S130, the perforated jacket plate 81 is arranged so as to be perpendicular to the rib body 821.

More specifically, in the second welding step S130, the perforated jacket plate 81 is arranged at a position where the rib body 821 inserted into the through-hole 811*c* is visible when the perforated jacket plate 81 is viewed from the outside in the radial direction Dr, so that the inner peripheral surface 811*d* of the perforated flat plate portion 811*a* is in a posture orthogonal to the rib body 821. In this manner, the perforated jacket plate 81 is arranged with respect to the rib body 821 in a state where the jacket side end portion 821*b* protrudes outward in the radial direction Dr from the through-hole 811*c*.

Thereafter, in the second welding step S130, the jacket side end portion 821*b* is welded so as to fill the through-hole 811*c* from the outside in the radial direction Dr. In this manner, in the second welding step S130, the jacket side end portion 821*b* is welded in a state which is the same as the state of being welded from both sides in the axial direction Da, and the rib body 821 is connected to the perforated jacket plate 81.

Thereafter, similarly to the first embodiment, in the third welding step S14, the perforated jacket plate 81 is welded to the outer peripheral surface 4*b* of the cylinder body 4 and a surface facing the upstream side of the flange 41.

According to the above-described manufacturing method S10 of the transition piece, in the second welding step S130, the perforated jacket plate 81 having the through-hole 811*c* formed at the position corresponding to the position of the rib body 821 is used. Accordingly, even when the jacket plate 61 is formed as a single member, it is possible to easily weld the jacket side end portion 821*b* from the though-hole 811*c*. Therefore, while the rib body 821 is welded from both sides in the axial direction Da, the cooling jacket 6 can be formed using fewer components. This can reduce operation man-hours and operation costs.

Thus, the embodiments of the present invention have been described with reference to the drawings. However, the configurations and combinations thereof in these embodiments are mere examples. Additions, omissions, substitutions, and other modifications can be made within the scope not departing from the spirit of the present invention. In addition, the present invention is not limited to the embodiments, but is limited only by the scope disclosed in Claims.

In the above-described embodiments, the transition piece 3 which is the cylinder of the combustor 1 has been described as an example. However, the scope of the present invention is not limited thereto. The present invention can also be applied to a pressure vessel where high-pressure fluid flows thereinside. Specifically, the present invention may be applied to a pressure vessel that has a first wall plate as a member to which the rib 62 is attached, instead of the cylinder body 4, and that has a second wall plate which opposes the first wall plate at a distance and forms the fluid space FS into which the high-pressure fluid flows between the first wall plate and the second wall plate, instead of the jacket plate 61.

In this configuration, in the rib 82, the first end portion (corresponding to the cylinder side end portion 821*a* in the present embodiment) on the first wall plate side in the separation direction (corresponding to the radial direction Dr in the present embodiment) where the first wall plate and the second wall plate are separated from each other is welded and connected to the first wall plate from a first side in the direction perpendicular to the separation direction (corresponding to the axial direction Da in the present embodiment) and from a second side which is opposite to the first side, with respect to the rib 82. Furthermore, in the rib 82, similarly to the first end portion, the second end portion (corresponding to the jacket side end portion 821*b* in the present embodiment) on the second wall plate side which is the end portion opposite to the first end portion is welded and connected to the second wall plate from the first side and the second side opposite to the first side, with respect to the rib 82.

According to the above-described pressure vessel, the first end portion of the rib 82 is welded to the first wall plate from both sides in the direction perpendicular to the separation direction, and the second end portion is welded to the second wall plate from both sides in the direction perpendicular to the separation direction. Therefore, it is possible to improve the welding strength in the first end portion by welding the rib 82 to the surface of the first wall plate so that the rib 82 is held from not only one side but from both sides in the direction perpendicular to the separation direction. Similarly, it is possible to improve the welding strength in the second end portion by welding both sides of the rib 82 in the direction perpendicular to the separation direction to the second wall plate. In addition, since the first end portion and the second end portion are welded from not only one side but from both sides in the axial direction Da, it is possible to make a crack less likely to grow from any of the two sides in the axial direction Da. Therefore, it is possible to make the crack further less likely to appear in the welded portion. In this manner, it is possible to fix the rib 82 to the first wall plate and the second wall plate firmly enough to stably maintain the bonded state even when the rib is subjected to a load inside the fluid space FS in which the high-pressure liquid circulates.

In addition, in the present embodiments, the transition piece 3 has been described as an example of the cylinder of the combustor 1. However, the present invention is not limited thereto. For example, as the cylinder of the combustor 1, a combustion liner may be adopted which is arranged on the downstream side of the combustor 1 and in which a flame is formed. Alternatively, a cylinder may be adopted in which the combustor basket and the transition piece are integrated with each other.

INDUSTRIAL APPLICABILITY

According to the cylinder of the above-described combustor 1, it is possible to improve the bonding strength of a rib by welding the end portions of the rib from both sides in the axial direction.

DESCRIPTION OF REFERENCE NUMERALS AND SIGNS

100 gas turbine
Ar rotor axis
101 compressor
102 turbine
103 casing
104 turbine rotor
105 first stage vane
G combustion gas
1 combustor
2 fuel supply unit
20 combustor basket
21 pilot nozzle
22 main nozzle
X fuel
A compressed air
3 transition piece
4 cylinder body
4*a* inner peripheral surface (of cylinder body)
4*b* outer peripheral surface (of cylinder body)
4*c* cooling flow channel
4*d* groove portion
Ac axis
Da axial direction
Dc circumferential direction
Dr radial direction
41 flange
5 steam inflow jacket
P high-pressure steam
6 cooling jacket
61 jacket plate
61*a* inner peripheral surface (of jacket plate)
FS fluid space
611 first jacket plate
611*a* flat plate portion
611*b*, 811*b* curved portion
611*c* inner peripheral surface (of flat plate portion)
612 second jacket plate
612*a* inner peripheral surface (of second jacket plate)
62, 72, 82 rib
621, 721, 821 rib body
621*a*, 721*a*, 821 *a* cylinder side end portion
621*b*, 721*b*, 821*b* jacket side end portion
S10 manufacturing method of transition piece
S11 preparation step
S12 first welding step
S13, S130 second welding step
S14 third welding step
722 bridge portion
81 perforated jacket plate
811*a* perforated flat plate portion
811*b* curved portion
811*c* through-hole
811*d* inner peripheral surface (of perforated jacket plate)

What is claimed is:

1. A cylinder of a combustor comprising:

a cylinder body inside of which combustion gas flows;

a jacket plate that surrounds the cylinder body and forms a fluid space into which high-pressure fluid flows between an inner peripheral surface of the jacket plate and an outer peripheral surface of the cylinder body; and at least one rib that connects the cylinder body and the jacket plate, wherein the at least one rib includes:

a first rib end portion formed on a cylinder body side in a radial direction with respect to an axis of the cylinder body, and having a first surface and a second surface each of which are welded to the cylinder body; and a second rib end portion formed on a jacket plate side in the radial direction, and having a first surface and a second surface each of which are welded to the jacket plate.

2. The cylinder of a combustor according to claim 1, wherein the distance between the outer peripheral surface of the cylinder body and the inner peripheral surface of the jacket plate is constant in the axial direction, and wherein the at least one rib is formed to be perpendicular to both the outer peripheral surface of the cylinder body and the inner peripheral surface of the jacket plate.

3. The cylinder of a combustor according to claim 2, wherein the at least one rib includes multiple ribs which are arranged at a distance from each other in a circumferential direction with respect to the axis, and which are welded to the cylinder body and the jacket plate and further includes at least one bridge portion each of which connect adjacent ribs to each other in the circumferential direction.

4. The cylinder of a combustor according to claim 2, wherein the jacket plate has a first jacket plate which is arranged on a first side in the axial direction with respect to the second rib end portion, and a second jacket plate which is arranged on a second side in the axial direction with respect to the second rib end portion, and wherein the first jacket plate and the second jacket plate are welded to the second rib end portion.

5. The cylinder of a combustor according to claim 2, wherein the jacket plate is formed with a through-hole penetrating in the radial direction, and wherein the at least one rib is welded to the jacket plate in a state that the second rib end portion is inserted into the through-hole.

6. The cylinder of a combustor according to claim 1, wherein the at least one rib has multiple ribs which are arranged at a distance from each other in a circumferential direction with respect to the axis, and which are welded to the cylinder body and the jacket plate and multiple bridge portions which connect adjacent ones of the multiple ribs to each other in the circumferential direction.

7. The cylinder of a combustor according to claim 6, wherein the jacket plate has a first jacket plate which is arranged on a first side in the axial direction with respect to the second rib end portion, and a second jacket plate which is arranged on a second side in the axial direction with respect to the second rib end portion, and wherein the first jacket plate and the second jacket plate are connected to the second rib end portion.

8. The cylinder of a combustor according to claim 6, wherein the jacket plate is formed with a through-hole penetrating in the radial direction, and wherein the at least one rib is welded to the jacket plate in a state that the second rib portion is inserted into the through-hole.

9. The cylinder of a combustor according to claim 1, wherein the jacket plate has a first jacket plate which is arranged on a first side in the axial direction with respect to the second rib end portion, and a second jacket plate which is arranged on a second side in the axial direction with respect to the second rib end portion, and wherein the first jacket plate and the second jacket plate are welded to the second rib end portion.

10. The cylinder of a combustor according to claim 9, wherein the first jacket plate includes a flat plate portion which has a flat plate shape and is welded to the at least one rib, and a curved portion which has a curved shape and is formed integrally with the flat plate portion and which is welded to the cylinder body.

11. The cylinder of a combustor according to claim 1, wherein the jacket plate is formed with a through-hole penetrating in the radial direction, and wherein the at least one rib is welded to the jacket plate in a state that the second rib end portion is inserted into the through-hole.

12. A method of manufacturing of a cylinder of a combustor which comprises a cylinder body inside of which combustion gas flows, a jacket plate that surrounds the cylinder body and forms a fluid space into which high-presser fluid flows between an inner peripheral surface of the jacket plate and an outer peripheral surface of the cylinder body, and at least one rib that connects the cylinder body and the jacket plate, the method comprising:

a first welding step of welding a first rib end portion to the cylinder body, the first rib end portion formed on a cylinder body side in a radial direction with respect to an axis of the cylinder body and having a first surface and a second surface each of which are welded to the cylinder body; and a second welding step of welding a second rib end portion to the jacket plate, the second rib end portion formed on a jacket plate side in the radial direction and having a first surface and a second surface each of which are welded to the jacket plate.

13. The method of manufacturing of a cylinder of a combustor according to claim 12, wherein, the cylinder of the combustor further comprises a first jacket plate which is arranged on a first side in the axial direction with respect to the second rib end portion of the at least one rib, and a second jacket plate which is arranged on a second side in the axial direction with respect to the second rib end portion are prepared, and wherein in the second welding step, the first jacket plate and the second jacket plate are welded to the at least one rib in the second rib end portion.

14. The method of manufacturing of a cylinder of a combustor according to claim 13, further comprising a third welding step of welding the first jacket plate to the cylinder body, the first jacket plate including a flat plate portion which has a flat plate shape and a curved portion which has a curved shape and is formed integrally with the flat plate portion, wherein in the third welding step, a first end of the curved portion in the axial direction is welded to the cylinder body along a circumferential direction of the cylinder body.

15. The method of manufacturing of a cylinder of a combustor according to claim 12, wherein a through-hole penetrating in the radial direction is formed on the jacket plate, and wherein in the second welding step, the at least one rib is welded to the jacket plate in a state that the second rib end portion is inserted into the through-hole.

16. A pressure vessel comprising:

a first wall plate;

a second wall plate that opposes the first wall plate with a distance therebetween, and that forms a fluid space into which high-pressure fluid flows between the first wall plate and the second wall plate; and at least one rib that connects the first wall plate and the second wall plate, wherein the at least one rib includes:

a first end portion formed on a first wall plate side in a separation direction where the first wall plate and the second wall plate are separated from each other, and having a first surface and a second surface each of which are welded to the first wall plate; and a second end portion formed on a second wall plate side in the separation direction and having a first surface and a second surface each of which are welded to the second wall plate.

17. The pressure vessel according to claim 16, wherein the second wall plate includes a flat plate portion which has a flat plate shape and is welded to the at least one rib, and a curved portion which has a curved shape and is formed integrally with the flat plate portion and which is welded to the first wall plate.

* * * * *